US008827080B2

(12) United States Patent
Holton

(10) Patent No.: US 8,827,080 B2
(45) Date of Patent: Sep. 9, 2014

(54) SINGLE SIDE SCREEN CLAMPING

(71) Applicant: Benjamin Lanning Holton, Dayton, KY (US)

(72) Inventor: Benjamin Lanning Holton, Dayton, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 13/672,429

(22) Filed: Nov. 8, 2012

(65) Prior Publication Data

US 2014/0124417 A1 May 8, 2014

(51) Int. Cl.
*B07B 1/49* (2006.01)
*B07B 1/00* (2006.01)

(52) U.S. Cl.
CPC ..... *B07B 1/00* (2013.01)
USPC ..... 209/395; 209/399; 209/403; 209/405

(58) Field of Classification Search
CPC ..... B07B 1/12; B07B 1/46; B07B 1/4609; B07B 1/485; B07B 1/4645; B07B 1/469; B07B 1/48; B07B 1/4663; B07B 1/49; B07B 1/4618; B07B 1/4672; B07B 2201/02
USPC ..... 209/395, 399, 403, 405
See application file for complete search history.

(56) References Cited

U.S. PATENT DOCUMENTS 3,795,311 A * 3/1974 Martin ..... 209/395
5,811,003 A * 9/1998 Young et al. ..... 210/388
6,964,341 B2 * 11/2005 Bacho et al. ..... 209/405
7,717,269 B2 * 5/2010 Bacho et al. ..... 209/399
7,819,255 B2 * 10/2010 Cady ..... 209/405
2005/0258080 A1 11/2005 Carr et al.
2008/0078705 A1 4/2008 Carr et al.
2008/0314804 A1 12/2008 Wojciechowski et al.
2010/0236995 A1 9/2010 Carr et al.

FOREIGN PATENT DOCUMENTS

WO 2005075114 A2 8/2005

OTHER PUBLICATIONS

International Search Report and Written Opinion issued in corresponding International Application No. PCT/US2013/068850; Dated Feb. 24, 2014 (13 pages).

* cited by examiner

*Primary Examiner* — David H Bollinger
(74) *Attorney, Agent, or Firm* — Osha Liang LLP

(57) ABSTRACT

An apparatus includes a vibratory separator, a screen support coupled to an inner surface of the vibratory separator, a screen having a first side with a sloped edge and a second side, the second side having a sloped edge, a screen retainer coupled to the vibratory separator, a wedge retainer coupled to a sidewall of the vibratory separator opposite the screen retainer, and a wedge having a first surface configured to engage the wedge retainer and a second surface configured to engage the a sloped edge of the second side of the screen. A method includes disposing a screen on a screen support in a vibratory separator, engaging a first side of the screen with a screen retainer coupled to the vibratory separator, and applying at least one of a downward vertical force and a lateral force to a second side of the screen with a clamping apparatus.

20 Claims, 13 Drawing Sheets

SINGLE SIDE SCREEN CLAMPING

BACKGROUND

Vibratory separators are used today to remove solid particulate of a certain size from fluid or other solid particulates of smaller sizes that may be passed through the separator. Various industries use vibratory separators for filtering materials, for example, the oil and gas industry, the food processing industry, the pharmaceutical industry, and the agriculture industry. A vibratory separator is a vibrating sieve-like table upon which a solids laden fluid is deposited and through which clean fluid emerges. Typically, the vibratory separator is a table with a generally perforated filter screen bottom. Fluid is deposited at the feed end of the vibratory separator. As the drilling fluid travels down the length of the vibrating table, the fluid falls through the perforations to a reservoir below, leaving the solid particulate material behind. The vibrating action of the vibratory separator table conveys solid particles left behind to a discharge end of the separator table.

The vibratory shaker includes a screen disposed within a basket of the vibratory separator. The screens themselves may be flat or nearly flat, corrugated, depressed, or contain raised surfaces. Due to the vibration or shaking of the vibratory separator, and the materials processed through the vibratory separator, the screens, as well as other parts, in the separator may wear over time. Therefore, screens are removably secured in the basket so they can be removed for repair or replacement.

The above described apparatus is illustrative of one type of shaker or vibratory separator known to those of ordinary skill in the art.

DETAILED DESCRIPTION

Embodiments disclosed herein relate to apparatus and methods for securing a screen to a vibratory separator. Specifically, embodiments disclosed herein relate to clamping apparatus for securing a screen in a vibratory separator. According to certain embodiments disclosed herein, a clamping system may include a wedge (also known as a wedge block) to secure one side of screen frame while the opposite side of the screen frame is secured within the vibratory separator by a screen retainer.

Figure 1:
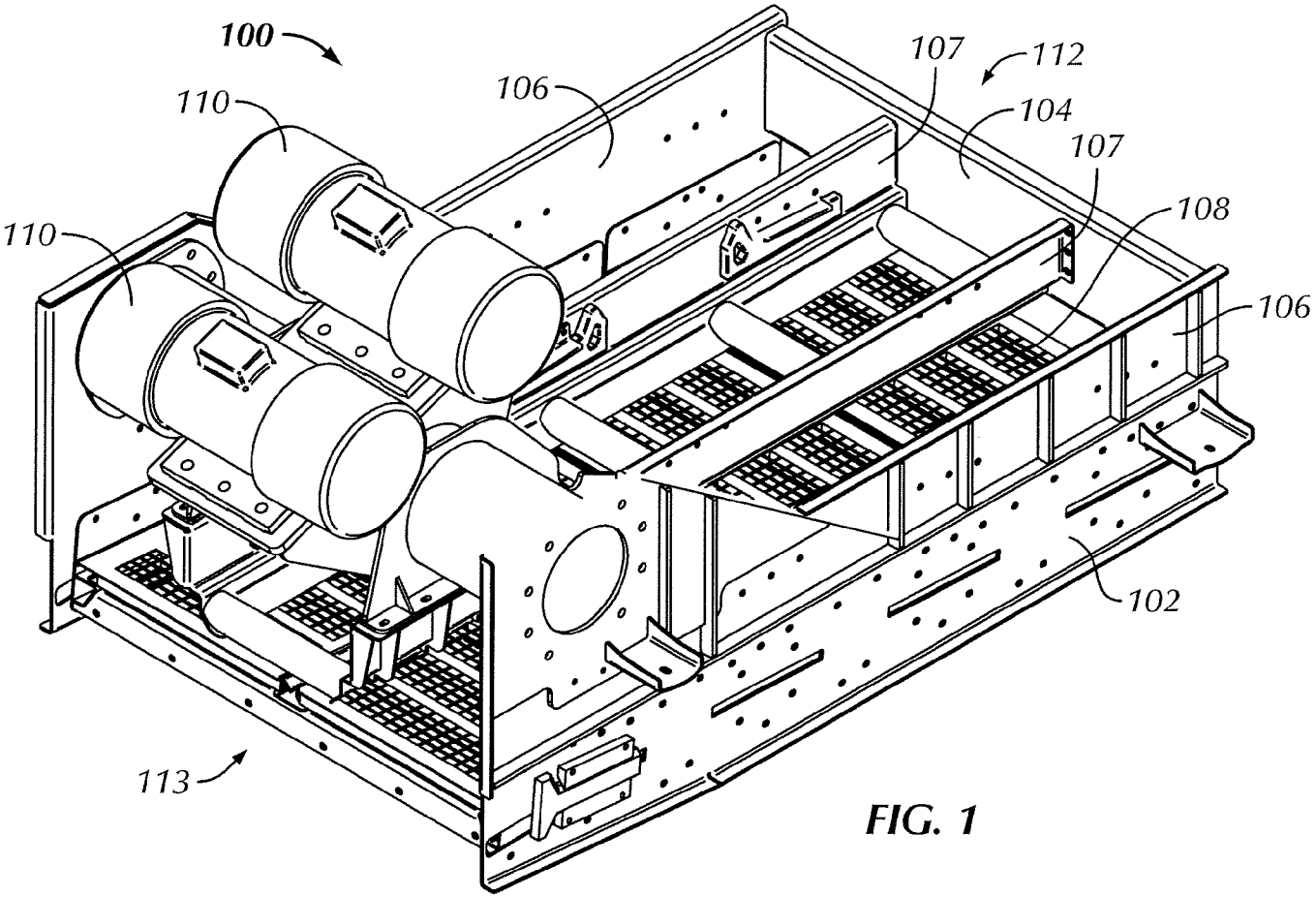
FIG. 1 is a perspective view of a vibratory separator in accordance with embodiments disclosed herein.

Referring initially to FIG. 1, a vibratory separator 100 may include a frame or skid 102 and a basket 104. The basket 104 includes two sidewalls 106. One or more screens 108 are disposed within the basket 104 and configured to filter or screen a fluid disposed within the basket 104 as the material moves across a length of the basket 104. In certain embodiments, the basket 104 may also include one or more interior walls 107 extending a length of the basket 104 between a feed end 112 and a discharge end 113. The interior walls 107 may provide structural support for securing one or more screens 108 within the basket 104. As used herein, a wall may refer to a sidewall 106 or an interior wall 107 of the basket 104.

The vibratory motion of the vibratory separator 100 may be generated by one or more motors 110 or actuation devices (not shown) coupled to the basket 104. The motors 110 and actuation devices may be placed on or be integral to the basket. For example, as shown in FIG. 1, two motors may be coupled to the basket 104 proximate the discharge end 113 of the vibratory separator 100. The location of the motors may facilitate the transference of forces generated by the motors to the basket by allowing a motor's shaft to couple to an actuator, which transfers motion to the basket.

Figure 2:
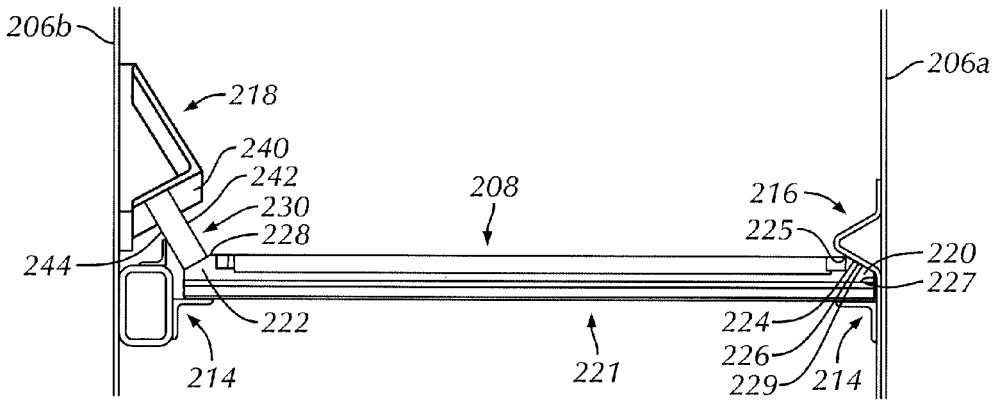
FIG. 2 is an end view of a screen disposed in a vibratory separator and secured by a clamping apparatus on a single side in accordance with embodiments disclosed herein.

Referring now to FIG. 2, an end view of a screen 208 disposed within a vibratory separator (not independently illustrated) for screening a material disposed therein is shown. As shown, the screen is disposed between two walls 206 of a basket (not independently illustrated) of a vibratory separator, a first wall 206*a* opposite a second wall 206*b* (e.g., between two sidewalls, between a sidewall and an interior wall, or between two interior walls). The screen 208 is supported on a lower surface by a screen support 214. The screen support 214 may be coupled to an inner surface of the basket. For example, as shown, the screen support may be coupled to walls 206 of the basket (not independently illustrated). The screen support 214 may be one or more brackets coupled to the walls 206 by any means known in the art, for example, mechanical fasteners, welding, adhesives, or integrally formed. In certain embodiments, the screen support 214 may be an L-bracket or similar device configured to engage a lower surface of the screen 208 and support the screen 208. As shown in FIG. 2, in certain embodiments, the screen support 214 may extend inwardly from and perpendicular to the wall 206. However, in other embodiments, as discussed in more detail below, the screen support 214 may extend inwardly from and angle downward or upward with respect to the sidewall of the basket as shown from an end view.

As shown, the screen 208 may include a first side 220 and a second side 222 extending longitudinally between a first end 221 and a second end (not shown). The screen 208 may include a plurality of openings extending from a top surface to a bottom surface. The openings may be sized so as to prevent particles of a certain size from falling through the screen 208 and may vary depending on the application, such as the fluid and/or the particles within the fluid. In some embodiments, a filtering element such as a screen mesh may be coupled to the screen 208. For example, a screen mesh may be coupled to the top surface of the screen 208. The filtering elements may further define the largest solid particle capable of passing therethrough.

The screen 208 may include one or more sloped edges. For example, one or more side edges of the screen (e.g., an edge between the top surface and a side surface the screen 208) may include a linearly sloped edge, a convex sloped edge, a concave sloped edge, non-sloped edge, or combinations thereof. As shown in FIG. 2, linearly sloped edges of the screen 208 may include one or more beveled edges. For example, a first side 220 of screen 208 may include a bevel 226 along a length of an upper edge of the screen 208. A second side 222 of screen 208 may also include a bevel 228 along a length of an upper edge of the screen 208. A beveled edge refers to an edge of the screen that is not perpendicular to the top surface or the side surface of the screen 208. A beveled edge 226, 228 may be defined between a top edge 225 and a bottom edge 227. As shown, the top edge 225 may be coplanar with a top surface of screen 208, while the bottom edge 227 is between the top surface and a bottom surface of the screen 208. The beveled edge 226, 228 may define a bevel surface 229 that has an angle of less than 90 degrees with respect to a horizontal plane through the bottom edge 227. In some embodiments, the beveled edge 226, 228 may extend from the top surface of the screen 208 to the bottom surface of the screen 208.

Figure 15A:
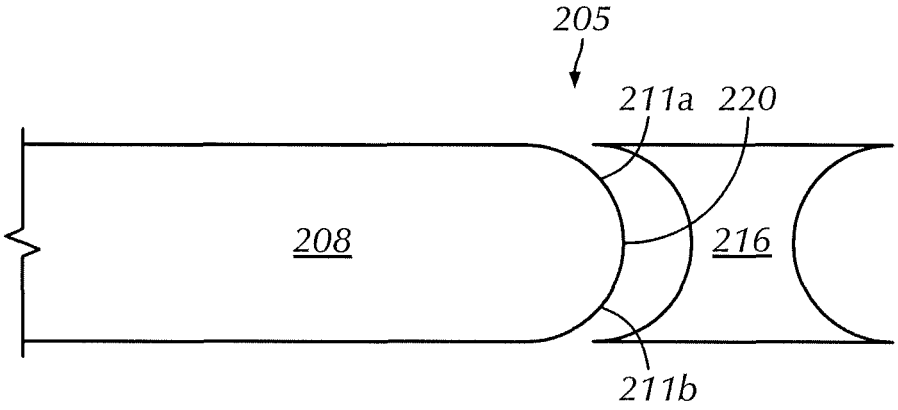
FIGS. 15A and 15B show partial side views of a screen disposed in a vibratory separator in accordance with embodiments disclosed herein.
Figure 15B:
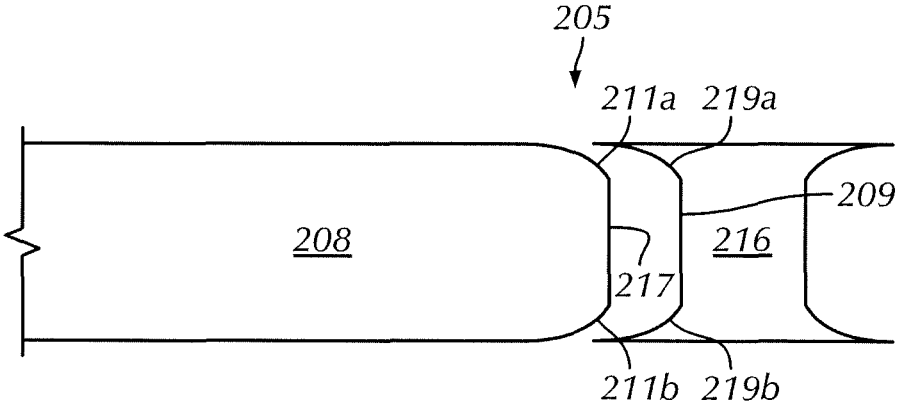

In other embodiments, as shown in FIGS. 15A and 15B, sloped edges 205 may include a convex sloped edge. For example, as shown in FIG. 15A, the screen 208 may include a first convex sloped edge 211*a* extending from the top surface of screen 208 to the first side 220 of the screen 208. The screen 208 may also include a second convex sloped edge 211*b* extending from the bottom surface of the screen 208 to the first side 220 of the screen. Thus, as shown in FIG. 15A, the first side 220 of screen 208 may be rounded from the top surface to the bottom surface of the screen. In some embodiments, the first side 220 of the screen 208 may include only one sloped edge 205, for example, a top sloped edge 211*a* or a bottom sloped edge 211*b* that connects the top or bottom surface and a non-sloped or vertical side edge of the screen 208.

Each side of the screen 208 may also include a combination of linearly sloped, convex sloped, concave sloped, and non-sloped edges. For example, as shown in FIG. 15B, the screen may include a first convex sloped edge 211*a* extending from the top surface of screen 208 to a non-sloped edge 217 (i.e., a vertical edge or surface) of the first side 220 of the screen 208. The screen 208 may also include a second convex sloped edge 211*b* extending from the bottom surface of the screen 208 to the non-sloped edge 217 of the first side 220 of the screen.

Although not shown, one of ordinary skill in the art will appreciate that the second (or opposite) side of the screen 208 may have sloped edge(s) identical to the sloped edge(s) of the first side 220. In other embodiments, the first and second sides of the screen may have any combination of sloped edges disclosed herein, such that the two sides of the screen have different sloped edge(s).

Referring to FIGS. 2, 15A, and 15B, because the sides of the screen 208 include sloped edges, a height of the screen at the sides of the screen 208 is less than a height of the screen 208 at or toward a center of the screen 208. Additionally, the width of the top surface of the screen 208 (i.e. the length of the top surface of the screen from left to right in FIGS. 2, 15A, 15B) may be shorter than the width of the bottom surface of the screen 208, as shown in FIG. 2.

In some embodiments, a lower edge of the screen 208 on the first and/or second side may also include a sloped edge. Thus, in certain embodiments, the width of the top surface of the screen and the width of the bottom surface of the screen may be equal, while the width of the screen at a mid-height (i.e., a height between the top and bottom surfaces of the screen) may be longer than the width of the top and bottom surfaces. In some embodiments, the entire edge of the screen may be sloped toward the side of the screen (i.e., along an entire length of the screen 208, or the edge may include discreet sections that are sloped. For example, beveled edges 226, 228 may be one substantially continuous beveled edge along the length of shaker screen 208, or may be separated into individual smaller surfaces (beveled edges) spaced along the length of screen 208. In some embodiments, a seal (not shown) may be disposed on one or more sloped edges (e.g., beveled surfaces 226, 228) to prevent or reduce debris or fluid from bypassing the screen 208.

As further shown in FIG. 2, in some embodiments, a screen retainer 216 is coupled to a first wall 206*a* opposite a wedge retainer 218 coupled to the second wall 206*b*. The screen retainer 216 and the wedge retainer 218 may be coupled to the first and second walls 206*a,b*, respectively, by any means known in the art, such as, for example, mechanical fasteners, welding, adhesives, or integrally formed. One of ordinary skill in the art will appreciate that the screen retainer 216 and/or the wedge retainer 218 may be directly or indirectly coupled to the walls 206*a,b*. For example, a spacer plate, rail, or other component may be disposed between the screen retainer 216 and/or wedge retainer 218 without departing from the scope of embodiments disclosed herein.

The screen retainer 216 is configured to contact and engage a surface of the screen 208 as the screen 208 is positioned in the vibratory separator. For example, the screen may be slid into place between the screen retainer 216 and the screen support 214. In particular, the screen retainer 216 is configured to contact or engage an upper surface of the screen at or near the first side 220 of the screen 208. In certain embodiments, screen retainer 216 may be angled. For example, the screen retainer 216 may include an angled surface 224 configured to match or correspond to an angled surface of the screen 208, e.g., bevel 226. In some embodiments, the screen retainer 216 may include a profile that corresponds to the profile of the first or second side of the screen. For example, as shown in FIG. 15A, screen retainer 216 includes a concave profile 219 that corresponds to and engages the first and second convex sloped edges 211*a*, 211*b* of the first side 220 of screen 208. Further, as shown in FIG. 15B, the screen retainer 216 includes a generally concave profile that includes a first concave slope 219*a*, a second concave slope 219*b*, and a non-sloped (or vertical) surface 209. In some embodiments, the profile of the screen retainer 216 may substantially or fully correspond to the profile of the side 220, 222 of the screen 208, such that the surface(s) of the first side of the screen (including the sloped or non-sloped surfaces) contact the corresponding surfaces of the screen retainer 216. In other embodiments, the profile of the screen retainer 216 may not fully correspond to profile of the side 220, 222 of the screen, such that, for example, the sloped edges 211*a*, 211*b* (FIG. 15B) may contact the corresponding sloped surfaces of the screen retainer 216, while the non-sloped edge 217 of the screen may not contact a surface of the screen retainer 216.

The screen retainer 216 is spaced above the screen support 214 a selected distance such that the screen 208 may be installed and secured between the screen support 214 and the screen retainer 216. In some embodiments, the screen support 214 and the screen retainer 216 may be spaced apart such that the screen may be slid from the end of the shaker (not shown) into the space formed between screen support 214 and the screen retainer 216. In some embodiments, a seal (not shown) may be disposed between the screen 208 and the screen retainer 216 to assist in securing screen 208 between screen retainer 216 and screen support 214.

The vibratory separator may also include a clamping apparatus disposed on a single side of the screen 208. The clamping apparatus may include a wedge 230 and the wedge retainer 218. The wedge 230 is configured to be inserted between a lower surface 240 of the wedge retainer 218 and an upper surface of the screen 208 at or near the second side 222 of screen 208. The wedge retainer 218 may be a bracket, such as an L-bracket, or a longitudinal rail, or similar device. The wedge retainer 218 is coupled to the second wall 206*b* a selected distance above the screen support 214. Specifically, the wedge retainer 218 is spaced above the screen support 214 a distance sufficient to allow the screen 208 to be disposed on the screen support 214 and between the wedge 230 and the wedge retainer 218. Further, the distance between the screen 208 (when engaged with the screen support 214) and the wedge retainer 218 is such that when the wedge 230 is engaged with the upper surface of the screen 208 and the lower surface of the wedge retainer 218, the wedge 230 secures the screen within the vibratory basket (not shown).

Figure 4:
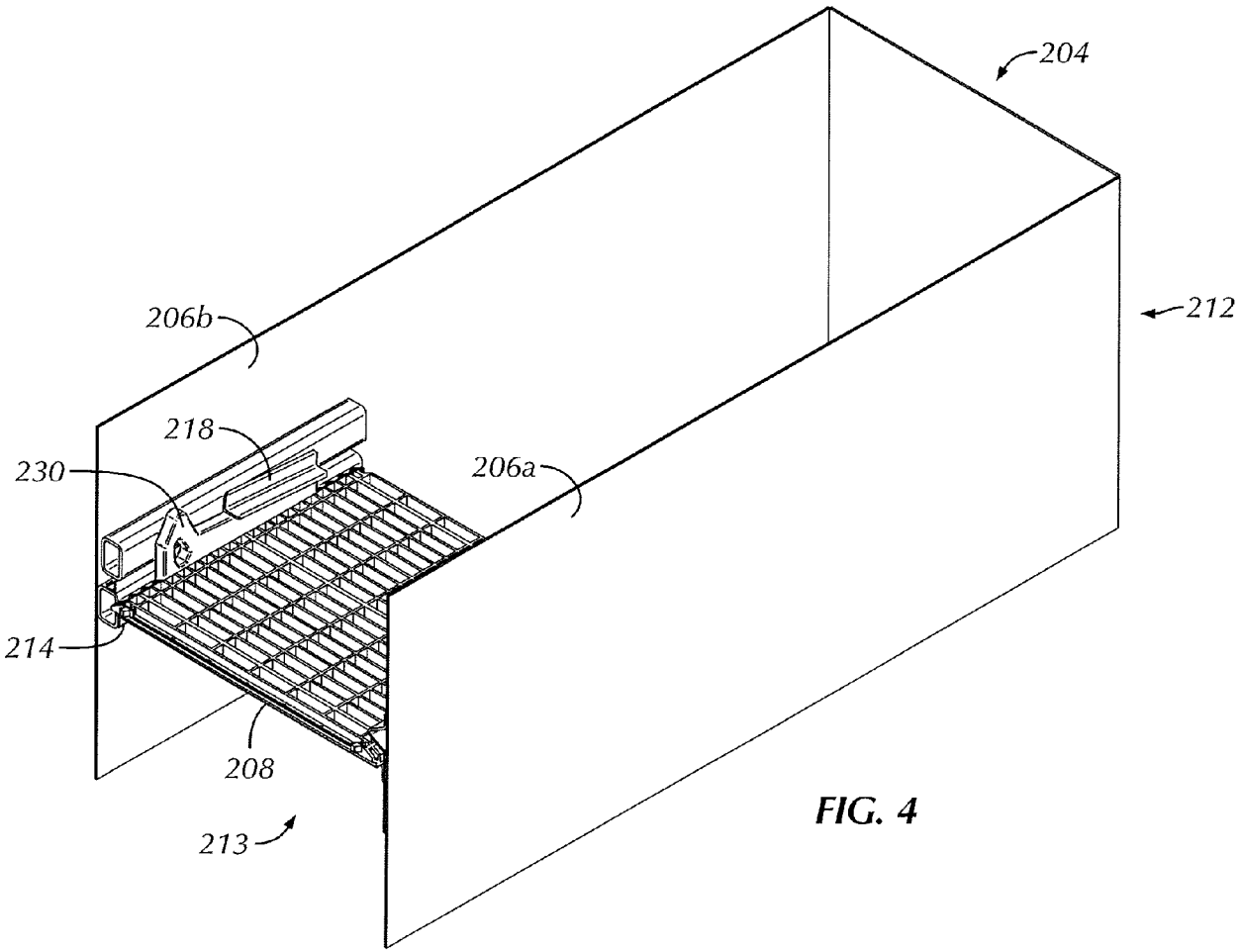
FIG. 4 is a perspective view of a screen disposed in a basket of a vibratory separator and secured by a clamping apparatus on a single side in accordance with embodiments disclosed herein.

Furthermore, the distance between the screen 208 and the wedge retainer 218 may vary along the length of the wedge retainer 218. For example, as shown in FIG. 4, the wedge retainer 218 may be angled along its length when installed in the basket 204. As shown, the vertical distance between the screen support 214 and the wedge retainer 218 is greater toward the discharge end 213 of the basket 204 than the vertical distance between the screen support 214 and the wedge retainer 218 toward the feed end 212 of the basket 204. However, in other embodiments, the vertical distance between the screen support 214 and the wedge retainer 218 is greater toward the feed end 214 of the basket 204 than the vertical distance between the screen support 214 and the wedge retainer 218 toward the discharge end 213 of the basket 204. The vertical distance, or height, between the screen support 214 and the wedge retainer 218 may decrease gradually between the discharge end 213 and the feed end 212. Thus, when the wedge 230 is installed in the vibratory separator, an interference fit of the wedge 230 between the wedge retainer 218 and the screen 208 may apply at least one of a downward force and a lateral force toward the wall 206*a* opposite the wall 206*b* of the clamping apparatus to secure the screen 208 within the basket (not shown).

Figure 3:
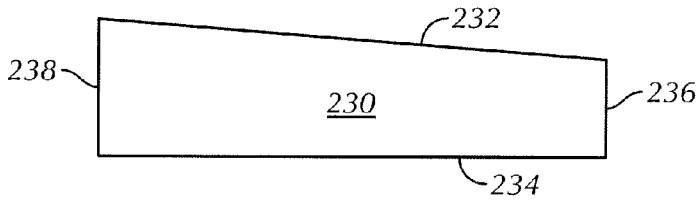
FIG. 3 is a side view of a wedge in accordance with embodiments disclosed herein.

FIG. 3 shows a side view of a wedge 230 that may be used in accordance with embodiments disclosed herein. As shown, the wedge 230 may include a top surface 232 and a bottom surface 234 extending in length between a front end 236 and a back end 238. The bottom surface 234 of the wedge 230 may be substantially flat, while the top surface 232 may be sloped from the back end 238 to the front end 236. In other words, the height of the wedge 230 may vary linearly along its length from the back end 238 to the front end 236. The slope of the top surface 232 may facilitate wedging of the wedge 230 between the wedge retainer 218 (FIG. 2) and the screen 208 (FIG. 2) to secure the screen 208 within the vibratory separator (not shown). One of ordinary skill in the art will appreciate that an opening or handle may be formed proximate the back end 238 of the wedge 230 to facilitate removal of the wedge 230 from between the wedge retainer 218 and the screen 208.

Referring to FIGS. 2 and 3, in some embodiments, the wedge retainer 218 may include a lower surface 240 that extends perpendicularly from a plane of an inner surface of second wall 206*b*. In other embodiments, the lower surface 240 of wedge retainer 218 may be angled with respect to the plane of the inner surface of the second wall 206*b*, as shown in FIG. 2. In the example shown in FIG. 2, the lower surface 240 of the wedge retainer 218 may be parallel to the bevel 228 of the second side 222 of the screen 208. In other words, an angle between the lower surface 240 of the wedge retainer 218 and the inner surface of the second wall 206*b* may be approximately equal to an angle of the bevel 228. Referring still to FIGS. 2 and 3, intersections between the top and bottom surfaces 232, 234 of the wedge 230 with first and second sides 242, 244, respectively, of the wedge 230 may be squared. Thus, the cross-section of the wedge 230, as shown in FIG. 2, is rectangular or square.

Thus, in the embodiment shown in FIG. 2, the wedge 230 is installed at an angle with respect to the second wall 206*b*. Specifically, a distance between the top surface 232 of wedge 230 and the second wall 206*b* is less than a distance between the bottom surface 234 of wedge 230 and the second wall 206*b*. Because the lower surface 240 of the wedge retainer 218 is approximately parallel to the bevel 228 of screen 208, and because the top and bottom surfaces 232, 234 of the wedge 230 are square with respect to the first and second sides 242, 244 of the wedge 230, the top surface 232 of wedge 230 securely engages the lower surface 240 of the wedge retainer 218 and the bottom surface of the wedge 230 securely engages the bevel 228 of the screen 208.

In the embodiment shown in FIG. 2, the wedge 230 is installed at an angle such that the installed wedge applies a downward vertical force and a lateral force to the second side 222 of the screen 208. The resultant force, therefore, pushes the screen 208 into the screen retainer 216, thereby securing the screen 208 in the basket of the vibratory separator using a clamping apparatus on a single side of the screen 208. In this embodiment, because the lower surface of the wedge retainer 218 is angled and the second side 222 of the screen 208 includes a bevel 228, a standard or conventional wedge may be used to secure the screen 208 in the vibratory separator with a clamping apparatus only on a single side of the screen.

Thus, in certain embodiments, a vibratory separator may be retrofitted such that a screen may be secured within the vibratory separator with a clamping apparatus on only a single side of a screen. For example, in certain embodiments, a vibratory separator may be retrofitted by installing a screen retainer 216 as described above, installing a wedge retainer 218 as described above, and using a screen having a beveled second side such that the angle of the bevel corresponds to the angle of a lower surface of the wedge retainer. A standard wedge having a sloped top surface and squared top and bottom surfaces with respect to parallel side surfaces may then be used to secure the screen within the vibratory separator.

Figure 5:
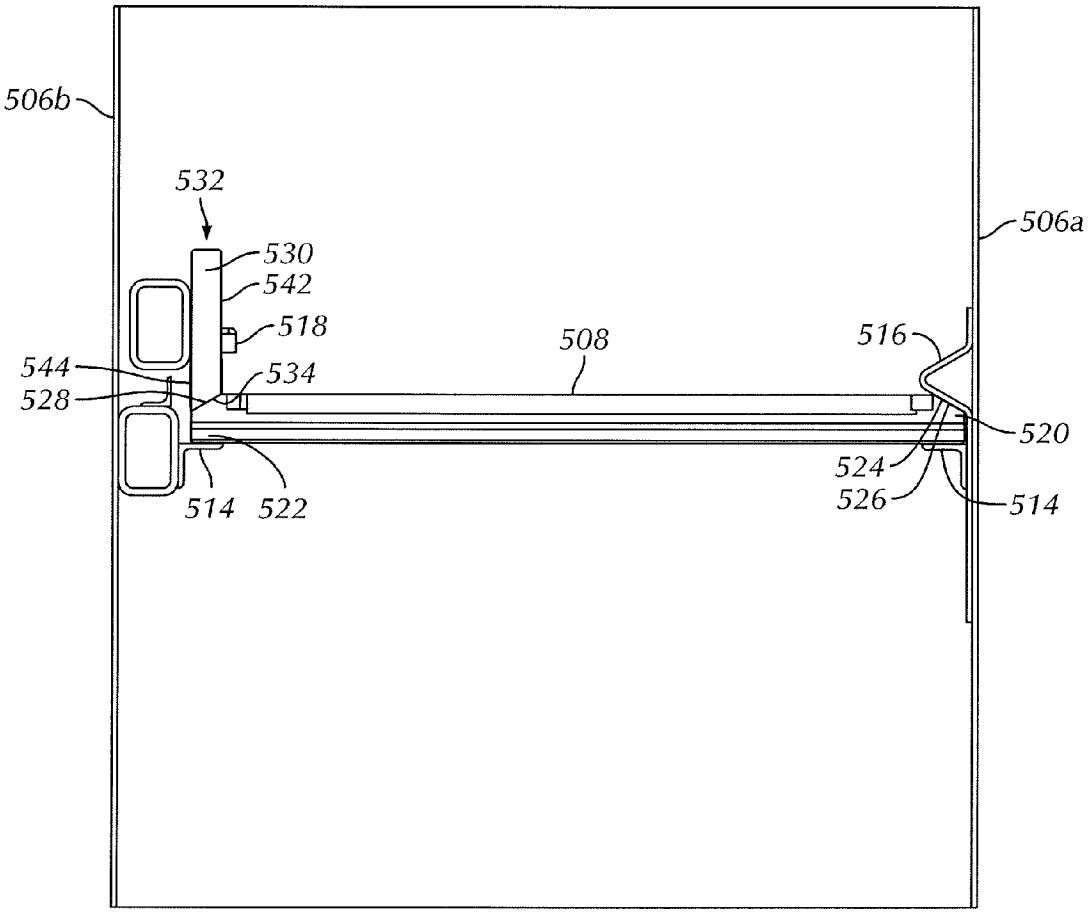
FIG. 5 is an end view of a screen disposed in a vibratory separator and secured by a clamping apparatus on a single side in accordance with embodiments disclosed herein.

Referring now to FIG. 5, an end view of a screen 508 installed between a first wall 506*a* and a second wall 506*b* of a vibratory separator (not independently illustrated) in accordance with embodiments disclosed herein is shown. The screen 508 is supported on a lower surface by a screen support 514. The screen support 514 may be coupled to an inner surface of the walls 506*a,b* of the basket (not independently illustrated). The screen support 514 may be one or more brackets coupled to the walls 506*a,b* by any means known in the art, for example, mechanical fasteners, welding, adhesives, or integrally formed. In certain embodiments, the screen support 514 may be an L-bracket or similar device configured to engage a lower surface of the screen 508 and support the screen 508. In certain embodiments, the screen support 514 may extend inwardly from and perpendicular to the walls 506*a,b*, as shown in FIG. 5. However, in other embodiments, the screen support 514 may extend inwardly from and angle downward or upward with respect to the sidewall of the basket as shown from an end view.

As shown, the screen 508 may include one or more beveled edges. For example, a first side 520 of screen 508 may include a bevel 526 along a length of an upper edge of the screen 508. A second side 522 of screen 508 may also include a bevel 528 along a length of an upper surface of the screen 508. In some embodiments, a lower edge of the screen on the first and/or second side may also include a bevel (not shown). Beveled edges 526, 528 may be one substantially continuous beveled edge along the length of shaker screen 508, or may be separated into individual smaller surfaces spaced along the length of screen 508. In some embodiments, a seal (not shown) may be disposed on one or more beveled surfaces 526, 528 to prevent or reduce debris or fluid from bypassing the screen 508.

Still referring to the embodiment shown in FIG. 5, a screen retainer 516 is coupled to the first wall 506*a* opposite a wedge retainer 518 coupled to the second wall 506*b*. The screen retainer 516 and the wedge retainer 518 may be coupled to the first and second walls 506*a,b*, respectively, by any means known in the art, such as, for example, mechanical fasteners, welding, adhesives, or integrally formed. One of ordinary skill in the art will appreciate that the screen retainer 516 and/or the wedge retainer 518 may be directly or indirectly coupled to the walls 506*a,b*. For example, a spacer plate, rail, or other component may be disposed between the screen retainer 516 and/or wedge retainer 518 without departing from the scope of embodiments disclosed herein.

Similar to the screen retainer 216 (FIG. 2) discussed above, the screen retainer 516 is configured to contact and engage a surface of the screen 508. In particular, the screen retainer 516 is configured to contact or engage an upper surface of the screen at or near the first side 520 of the screen 508. In certain embodiments, screen retainer 516 may be angled. For example, the screen retainer 516 may include an angled surface 524 configured to match or correspond to an angled surface of the screen 508, e.g., bevel 526. The screen retainer 516 is spaced above the screen support 514 a selected distance such that the screen 508 may be installed and secured between the screen support 514 and the screen retainer 516, as discussed above with respect to the embodiment shown in FIG. 2.

As shown in FIG. 5, a clamping apparatus is disposed on a single side of the screen 508. The clamping apparatus may include a wedge 530 and the wedge retainer 518. The wedge 530 is configured to be inserted between a lower surface of the wedge retainer 518 and an upper surface of the screen 508 at or near the second end 522 of screen 508. The wedge retainer 518 may be a bracket, such as an L-bracket (as shown, for example in FIG. 6 at 618), or a longitudinal rail, or similar device. The wedge retainer 518 is coupled to the wall 506*b* a selected distance above the screen support 514, as described above with respect to the embodiment shown in FIG. 2. In some embodiments, the wedge retainer 518 may be angled along its length when installed in the basket (not shown). When the wedge is installed in the vibratory separator, an interference fit of the wedge 530 between the wedge retainer 518 and the screen 508 may apply at least one of a downward force and a lateral force toward the wall 506*a* opposite the wall 506*b* of the clamping apparatus to secure the screen 508 within the basket (not shown).

In some embodiments, the wedge retainer 518 may include a lower surface (not shown) that extends perpendicularly from a plane of an inner surface of second wall 506*b*. In other embodiments, the lower surface (not shown) of wedge retainer 518 may be angled with respect to the plane of the inner surface of the second wall 506*b*, as shown in FIG. 2 at 240. In the example shown in FIG. 5, the lower surface of the wedge retainer 518 may be parallel to screen support 514. A top surface 532 of the wedge 530 may be parallel to the lower surface of the wedge retainer 518. However, a bottom surface 534 of the wedge 530 may be angled. Specifically, the bottom surface 534 may be angled between a first side 542 and a second side 544 of the wedge 530. In other words, the height of the first side 542 of the wedge is different than a height of the second side 544 of the wedge 530 at a corresponding longitudinal location. The intersections between the top surface 532 and sides 542, 544 of the wedge 530 may be squared. In certain embodiments, the angle of the bottom surface 534 of the wedge 530 may correspond to an angle of the bevel 528 of the second side 522 of the screen 508. The wedge 530 may further include an opening or handle toward one end of the wedge 530 (as shown by wedge 630 in FIG. 6) to facilitate removal of the wedge from between the wedge retainer 518 and the screen 508.

In the embodiment shown in FIG. 5, the wedge may be installed vertically (i.e., parallel to second wall 506*b*) in the vibratory separator (not shown) between the wedge retainer 518 and the screen 508. The top surface 532 of the wedge engages a lower surface of the wedge retainer 518, and the angled bottom surface 534 of the wedge 530 engages the bevel 528 of the screen 508. Because the bottom surface 534 of the wedge is angled, the wedge applies a downward vertical force and a lateral force (i.e., in a direction toward the first wall 506*a*) to the second side 522 of the screen 508. The resultant force, therefore, secures the screen 508 in the basket of the vibratory separator using a clamping apparatus on a single side of the screen 508 and a screen retainer 516 on an opposite side of the screen 508.

In some embodiments, more than one screen may be installed in a vibratory separator. A vibratory separator may include one, two, three, four, or more screens. In some embodiments, the screens may be disposed in the vibratory separator in a single row, one next to the other from the feed end to the discharge end. In such embodiments, a screen retainer may be coupled to a single side of a basket of a vibratory separator, while a clamping apparatus may be coupled to an opposite side of the basket. In other embodiments, screens may be disposed side by side between the first and second sides of a basket of a vibratory separator and between the feed end and the discharge end of the basket, as shown in, for example FIGS. 1 and 6.

As shown in FIG. 1, in some embodiments a vibratory separator may include outer walls 106 and interior walls 107. Thus, in embodiments where a vibratory separator has inner walls, a screen may be secured between two inner walls or an outer wall and an inner wall. Specifically, a screen retainer may be coupled to one wall and a wedge retainer coupled to an opposite wall. In other embodiments, a vibratory separator may include screens disposed side by side between two outer walls without an inner wall. In this embodiment, a screen retainer 616 may be disposed in the basket between the screens, as shown in FIG. 6.

Figure 6:
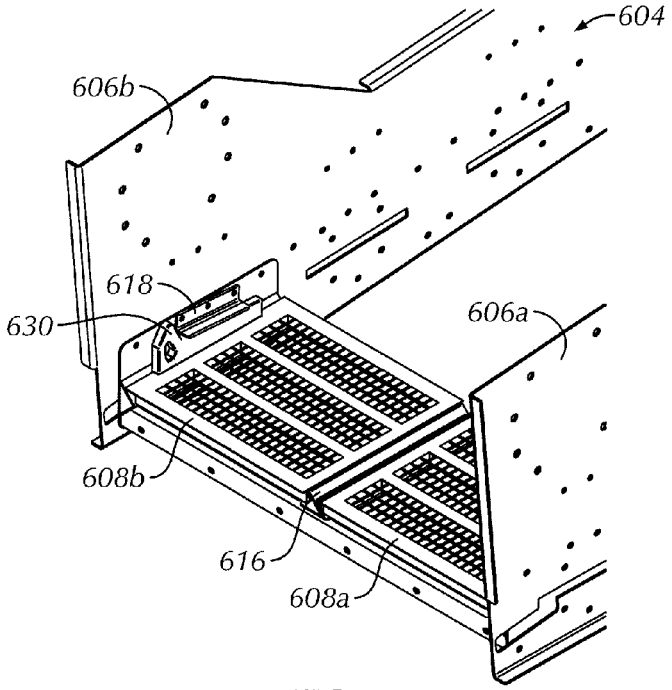
FIG. 6 is a perspective view of multiple screens disposed in a basket of a vibratory separator, each screen secured by a clamping apparatus on a single side, in accordance with embodiments disclosed herein.

Referring to FIG. 6, a vibratory separator having a basket 604 with at least two screens 608 disposed therein is shown. Basket 604 includes a first wall 606*a* and a second wall 606*b*. As shown, at least two screens are disposed side by side between the first and second walls 606*a, b*. A screen support (not shown) is coupled to the first and second walls 606 *a, b*, and along at least a portion of a length of the basket 608 between the two screens 608 to support the screens 608. A screen retainer 616 is disposed in the basket 64 between the screens 608 a selected distance above the screen support (not shown) disposed between the screens 608. In some embodiments, the screen retainer 616 and the screen support (not shown) may be formed as a single component. For example, two or more brackets may be coupled together by bolting, welding, or other means known in the art to provide both a screen support and a screen retainer for the screen 608. In other embodiments, the screen support and screen retainer may be an integrally formed component. The screen retainer may be coupled to the screen support (not shown) or to a lower surface or rail of the basket 604. A clamping apparatus may be disposed on a single side of first screen 608*a* and a single side of second screen 608*b*. For example, a wedge retainer 618 may be coupled to the second wall 606*b* and configured to receive a wedge 630 to secure the second screen 608*b* within the basket 604. Similarly, a wedge retainer (not shown) may be coupled to the first wall 606*a* and configured to receive a wedge (not shown) to secure the first screen 608*a* within the basket 604. The clamping apparatus may be any clamping apparatus disclosed herein such that each screen is secured within the basket by clamping apparatus disposed on only a single side of the screen.

Figure 7:
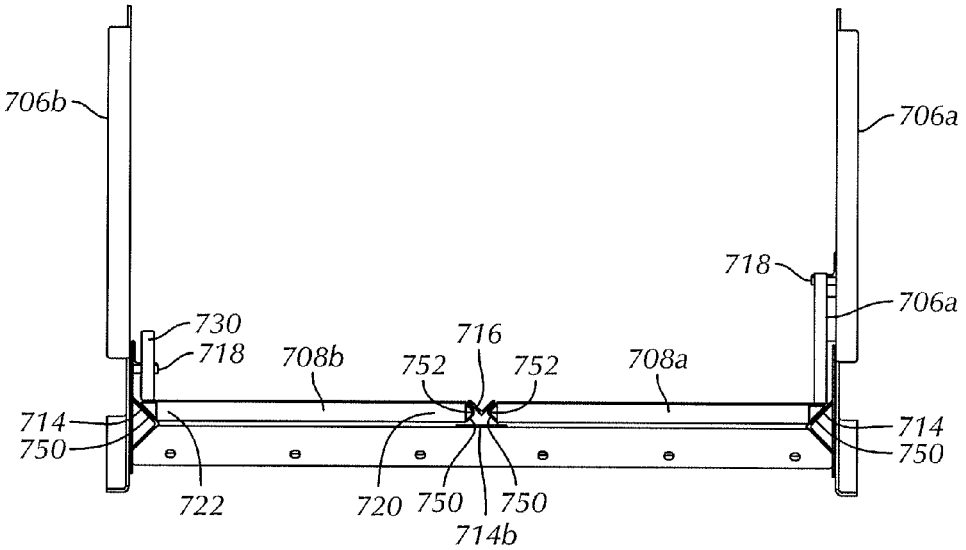
FIG. 7 is an end view of multiple screens disposed in a basket of a vibratory separator, each screen secured by a clamping apparatus on a single side, in accordance with embodiments disclosed herein.

Referring now to FIG. 7, in some embodiments the screen support 714 may extend inwardly from and angle downward or upward with respect to the wall 706*a,b* of the basket (not shown) as shown from an end view. The screen support 714 may be one or more brackets coupled to the walls 706 by any means known in the art, for example, mechanical fasteners, welding, adhesives, or integrally formed. In certain embodiments, the screen support 714 may be an L-bracket or similar device configured to engage a lower surface of the screens 708 and support the screen 708. As shown in FIG. 7, the screen support 714 extends inwardly from the walls 706*a, b* and angles downwardly. A center screen support 714*b* (i.e., a screen support between two screens) may include a bracket or rail coupled to a lower surface of the basket (not shown) and may angle downward from the center of the basket toward the walls 706*a,b*. In this embodiment, second screen 708*b* includes a beveled edge 750 on a lower surface of the first and second sides 720, 722 of the screen 708*b*. The beveled edges 750 are configured to engage the screen supports 714, 714*b*. Thus, in some embodiments, an angle of the bevel of the screens 708 is approximately the same as an angle of inclination of the screen supports 714. First screen 708*a* may include beveled edges 750 similar to those as screen 708*b*.

Each of the screens 708 may further include a beveled edge 752 on an upper surface. As shown in FIG. 7, in one embodiment, only a single side of each screen may include a beveled edge 752 on an upper surface. The beveled edges 752 on the upper surfaces of screens 708 may be disposed proximate each other and configured to engage a screen retainer 716. Screen retainer 716 extends along at least a portion of the length of the basket between the feed end and the discharge end and is disposed a selected distance above center screen support 714*b*. In the embodiment shown, the screens 708 include a double beveled side proximate the center of the basket and a single beveled side proximate the walls 706 of the basket. In some embodiments, the screen retainer 716 and the screen support 714 may be formed as a single component. For example, two or more L-brackets may be coupled together by bolting, welding, or other means known in the art to provide both a screen support and a screen retainer for the screen 708. In other embodiments, the screen support and screen retainer may be an integrally formed component.

As further show in FIG. 7, clamping apparatus are disposed on a single side of each of the screens 708. Specifically, a wedge retainer 718 is coupled to each wall 706*a,b* above screens 708. Wedges 730 in accordance with embodiments described herein are engaged with the wedge retainer 718 and an upper surface of the screens 708. The wedges 730 may include parallel top and bottom surfaces and parallel side surfaces as described above with respect to FIG. 2. Lower surfaces of the wedge retainers 718 may be perpendicular to a plane of the inner surfaces of the walls 706*a, b*. Thus, when the wedges 730 are installed, the wedges may remain substantially vertical (i.e., parallel to the walls 706 of the basket). Because the screen supports 714, 714*b* are angled, and because the bottom surfaces of the screens include a bevel 750 for engaging the screen supports 714, 714*b*, when the wedges 730 are installed on a single side of the screens 708, a downward vertical force and a lateral force is applied to each of the screens 708. The resultant force secures the screens within the screen retainer 716 and within the basket.

In some embodiments, the screens 708 may include a double beveled edge on both the first and second ends of the screen. For example, a wedge as shown in FIG. 5 may be used with a system as shown in FIG. 7. Therefore, the screens 708 may include a beveled edge on a lower surface of screen to engage the screen support 714 and a beveled edge on an upper surface of the screen to engage a wedge having an angled lower surface, as discussed above.

Figure 8:
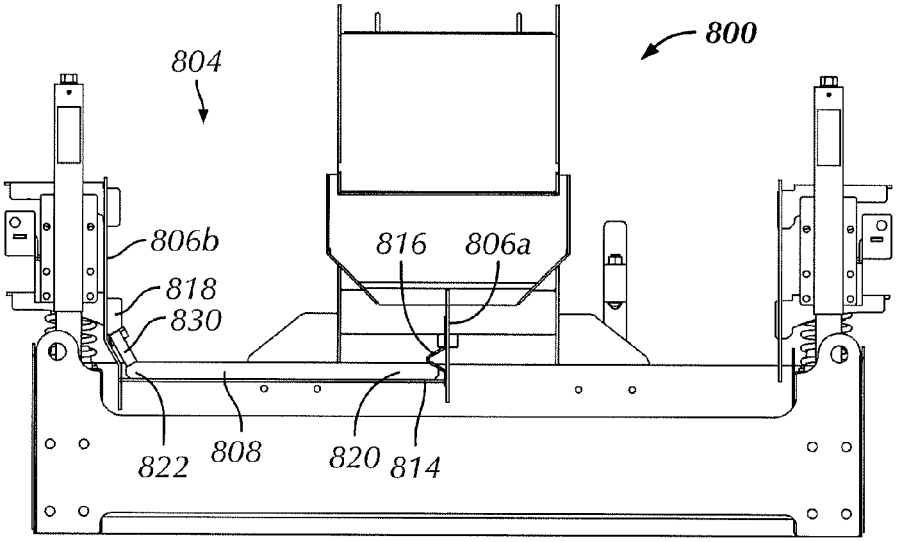
FIGS. 8 and 9 show end views of a vibratory separator during installation of a screen therein, the screen being secured by a clamping apparatus on a single side.
Figure 9:
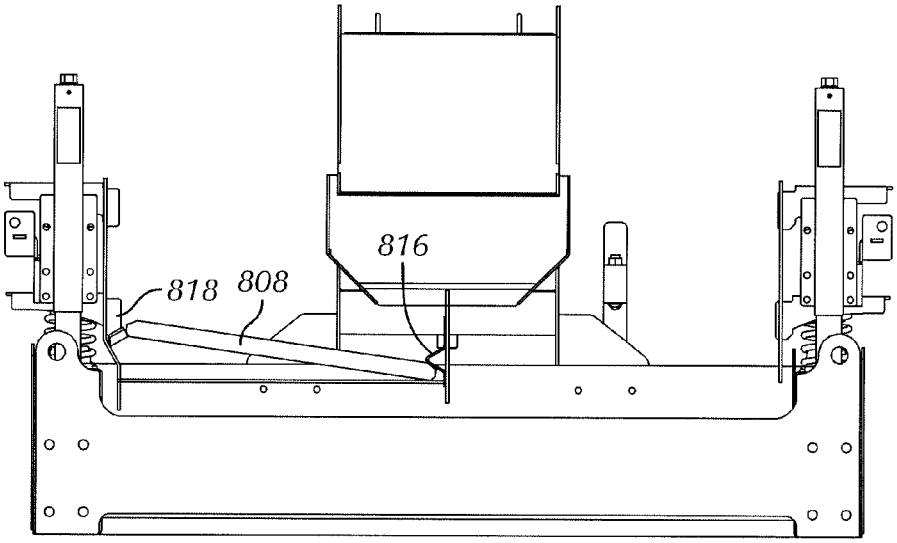

FIGS. 8 and 9 show a screen 808 having two doubled beveled edges. Specifically, a first end 820 of screen 808 includes a beveled edge on a lower surface and a beveled edge on an upper surface. While screen support 814 is not angled in this embodiment, a beveled edge on the lower surface of the screen 808 may facilitate installation of the screen within the basket 804, and specifically within screen retainer 816. For example, as shown in FIGS. 8 and 9, as the screen is installed, the first side 820 of the screen 808 may be placed on the screen support and slide into a space formed between the screen support 814 and screen retainer 816. The beveled edge on the lower surface of first end 820 of screen 808 may allow the screen to be rotated or pivoted about the first side as it is installed in the vibratory separator 800. In some embodiments, as shown here, the screen support 814 may be a plate coupled between the walls 806*a* and 806*b* of basket 804 of vibratory separator 800. Once the screen is engaged with the screen retainer 816 and supported by the screen support 814, a wedge 830 may be installed or wedged between the wedge retainer 818 and the screen 808, as shown in FIG. 8.

Figure 10:
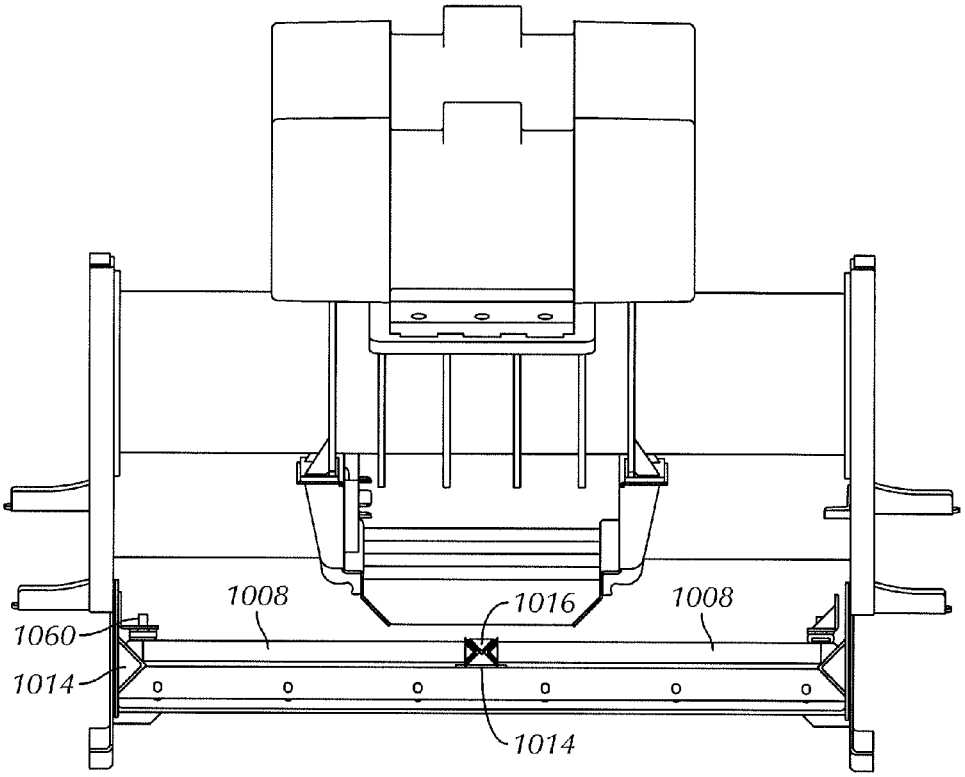
FIG. 10 is an end view of multiple screens disposed in a basket of a vibratory separator, each screen secured by a clamping apparatus on a single side, in accordance with embodiments disclosed herein.

FIG. 10 shows a partial end view of a vibratory separator with a screen 1008, a screen support 1014, and a screen retainer 1016. The screen 1008, the screen support 1014, and the screen retainer 1016 may be similar to those described above. In this embodiment, however, the clamping apparatus may include a pneumatic actuator 1060 coupled to the basket and configured to engage an upper surface of screen 1008 when actuated. The pneumatic actuator may be configured to apply a downward force on the screen 1008. However beveling of the screen 1008 and angling of the screen support 1014 and/or screen retainer 1016 may secure the screen axially and laterally within the basket. One of ordinary skill in the art will appreciate that other types of actuators may be used to engage and apply a downward force on an upper surface of screen 1008. For example, the actuator may be an electrical actuator, a hydraulic actuator, or a pneumatic actuator (as described above).

Figure 11A:
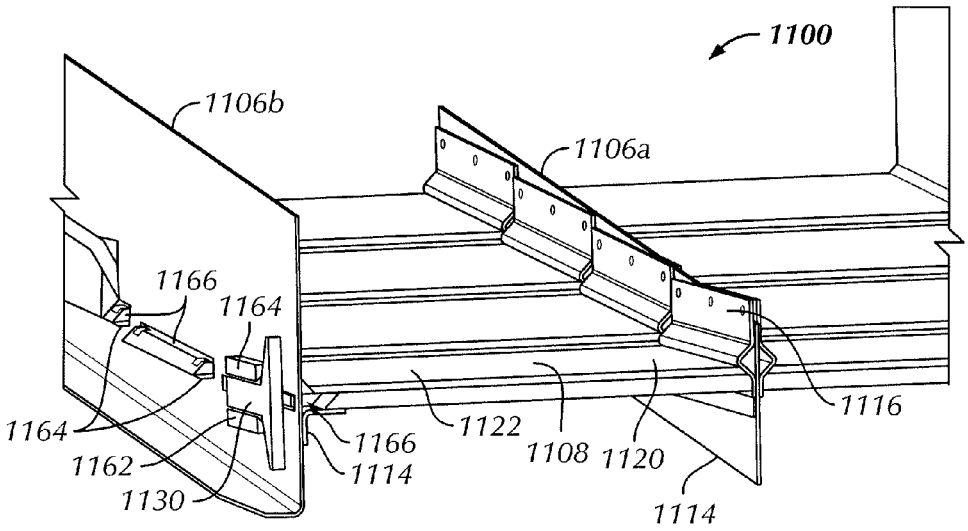
FIG. 11A is a perspective view of multiple screens disposed in a basket of a vibratory separator, each screen secured by a clamping apparatus on a single side, in accordance with embodiments disclosed herein.

FIG. 11A shows an apparatus in accordance with embodiments disclosed herein for securing a screen within a vibratory separator with a clamping apparatus along a single side of the screen. As shown, vibratory separator 1100 may include at least two walls. The vibratory separator may include a first wall 1106*a* and a second wall 1106*b*. One or more screens 1108 may be disposed within the vibratory separator 1100. Each screen 1108 is supported by a screen support 1114. The screen support 1114 may be coupled to the first and second walls 1106*a,b* and may be similar to the screen supports described above. A screen retainer 1116 is coupled to the first wall 1106*a* a selected distance above the screen support 1114 coupled to the first wall 1106*a*. The screen retainer 1116 may include an angled lower surface configured to engage a sloped edge of an upper surface of a first side 1120 of screen 1108.

The vibratory separator 1100 may also include a clamping apparatus for securing a single side of the screen 1108 within the vibratory separator 1100. The clamping apparatus may include a wedging track 1162 coupled to an outside surface of the second wall 1106*b* of the vibratory separator 1100. The wedging track 1162 is disposed proximate an opening 1164 formed in the second wall 1106*b*. Specifically, a first portion of the track 1162 may be disposed above the opening 1164 and a second portion of the track 1162 may be disposed below the opening 1164, such that the track 1162 straddles the opening 1164. A wedge 1130 is configured to slide into and engage the wedging track 1162 on a side of the second wall 1106*b* opposite the screen 1108. The wedge 1130 is also configured to engage the screen 1108 through the opening 1164.

In one embodiment, the screen 1108 may include an extension portion (not shown) extending from the second side 1122 of the screen 1108. The extension portion (not shown) may extend through the opening 1164. As the wedge 1130 is slid into engagement with the wedging track 1162, the wedge 1130 may engage the extension portion of the screen 1108 and apply a lateral force on the screen 1108. The applied lateral force may then secure the screen 1108 within the screen retainer 1116 and within the vibratory separator 1100.

Figure 11B:
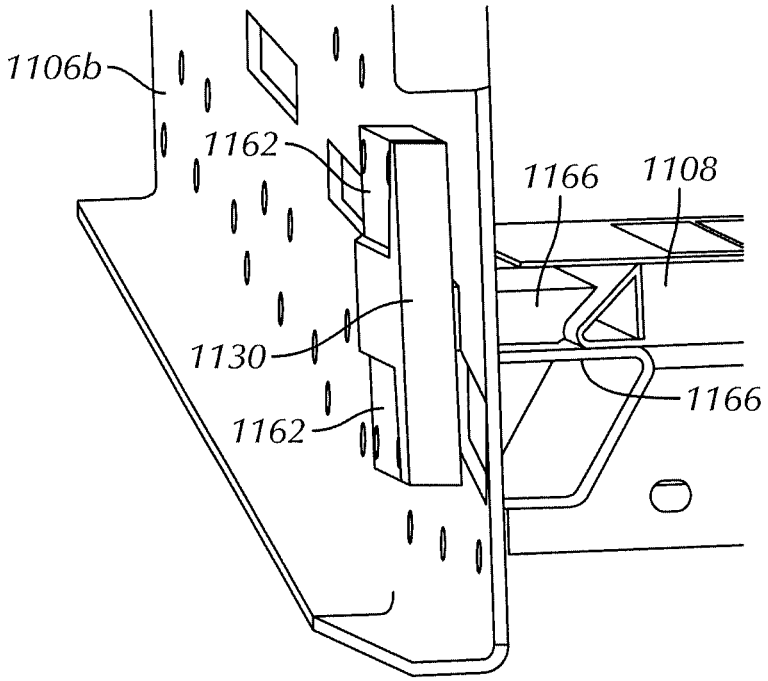
FIG. 11B is a close perspective view of a screen disposed in a vibratory separator, the screen secured by a clamping apparatus on a single side, in accordance with embodiments disclosed herein.
Figure 12C:
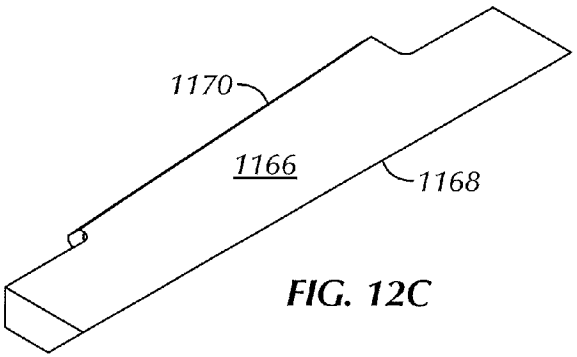
FIGS. 12A-12C show a top view, an end view, and a perspective view, respectively, of a clamping element of a clamping apparatus in accordance with embodiments disclosed herein.
Figure 12A:
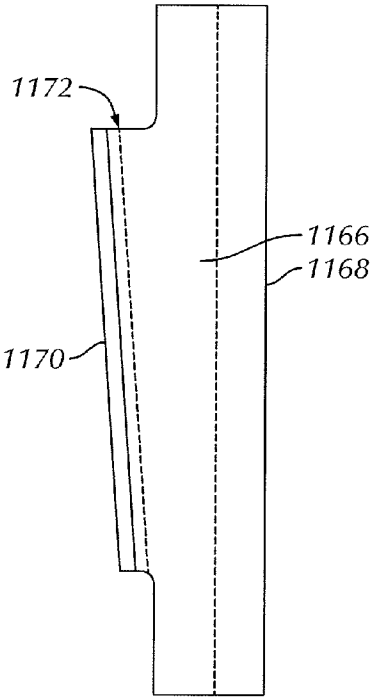
Figure 12B:
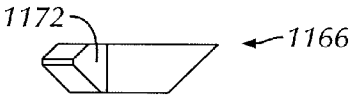

In another embodiment, a clamping element 1166 (shown with respect to a second screen disposed within the vibratory separator 1100) may be configured to engage the second side 1122 of the screen 1108 and configured to extend through the opening 1164. FIGS. 12A-12C show a top view, an end view, and a perspective view, respectively, of clamping element 1166. Clamping element 1166 may include a first side 1168 and a second side 1170. The first side 1168 of the clamping element 1166 is configured to engage the screen 1108. The first side 1168 may be beveled as shown in FIGS. 12B and 12C and configured to engaged a beveled edge of the second side 1122 of screen 1108. One of ordinary skill in the art will appreciate that the direction of the angle of the bevel of the clamping element 1166 may be selected so as to correspond to and engage with the bevel of the second side 1122 of the screen 1108. The extension portion 1172 of the clamping element 1166 may include a beveled edge or a double beveled edge, as shown in FIG. 12B. Additionally, the extension portion 1172 may be angled along its length, as shown in FIG. 12A. FIG. 11B shows a close perspective view of another example of a clamping apparatus where like parts are represented by like numerals.

As shown in FIG. 12A, the second side 1170 of the clamping element 1166 may include an extension portion 1172 configured to extend through the opening 1164 (FIG. 11A). A longitudinal length of the extension portion 1172 may be less than a longitudinal length of the first side 1168 of the clamping element 1166. A longitudinal length of the opening 1164 (FIG. 11A) may be longer than the extension portion 1172, but shorter than the first side 1168, such that the clamping element may be retained within the vibratory separator 1100 (the first side abutting an inner surface of the second wall 1106*b* (FIG. 11A)) while the extension portion may extend into or through the opening 1164.

Figure 13B:
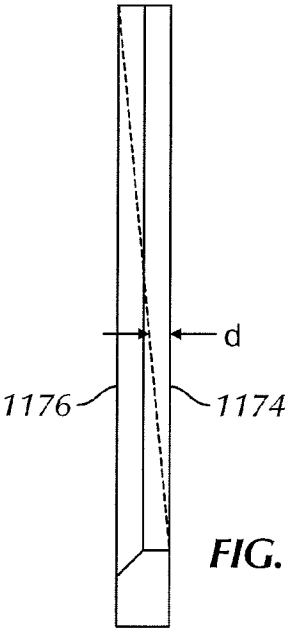
FIGS. 13A-13C show a perspective view, a top view, and an end view, respectively, of a wedge in accordance with embodiments disclosed herein.
Figure 13C:
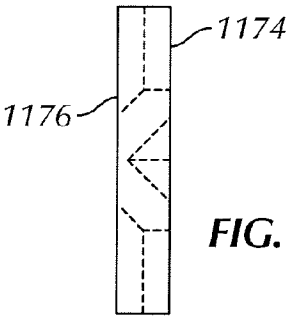
Figure 13A:
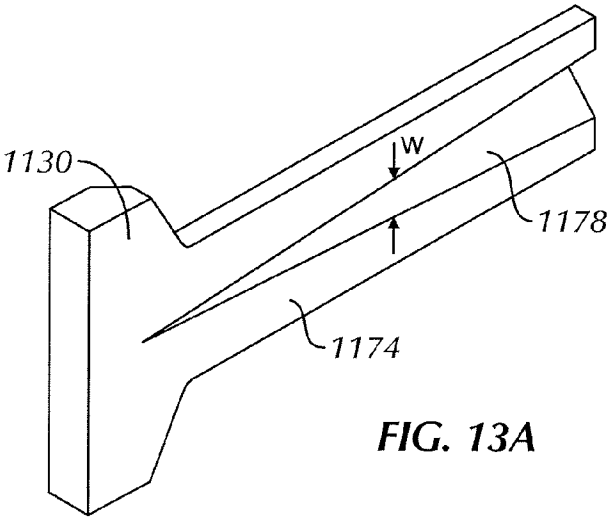

The second side 1170, and specifically, the extension portion 1172, of the clamping element 1166 is configured to engage a surface of the wedge 1130 (FIG. 11A) when the wedge engages the wedging track 1162 (FIG. 11A). Referring now to FIGS. 13A-13C, a perspective view, a top view, and an end view of the wedge 1130 according to embodiments disclosed herein are shown. Wedge 1130 includes a first side surface 1174 and a second side surface 1176. The first side surface 1174 includes a longitudinal groove 1178 configured to receive the second side 1170 (FIG. 12) of the clamping element 1166 (FIG. 12). As shown in FIG. 13B, a depth d of the longitudinal groove 1178 may be tapered along a length of the wedge 1130. Additionally, as shown in FIG. 13A, a width w of the longitudinal groove 1178 may be tapered along a length of the wedge. In other words, the width w and the depth d of the longitudinal groove 1178 may not be constant along the length of the wedge 1130.

Figure 14A:
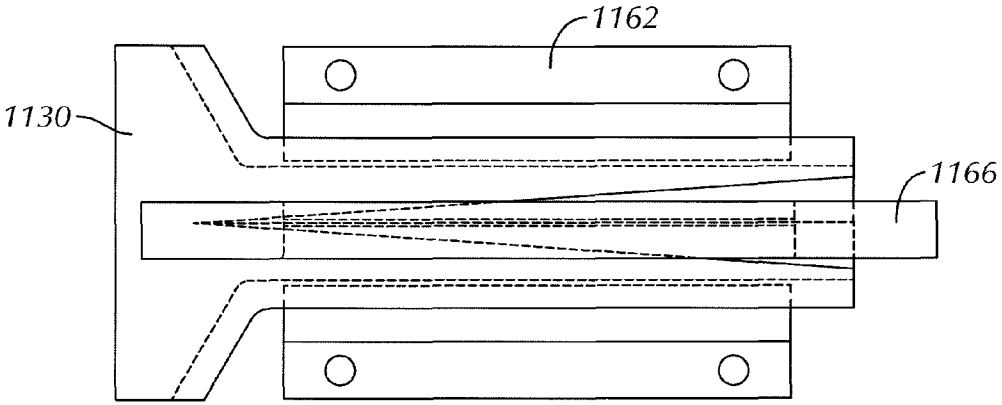
FIGS. 14A-14C show a side view, a top view, and an end view, respectively, of the clamping element of FIGS. 12A-12C engaged with the block of FIGS. 13A-13C in accordance with embodiments disclosed herein.
Figure 14C:
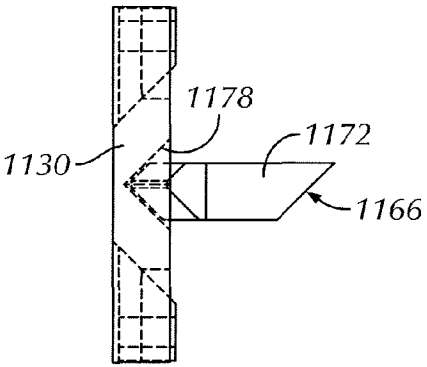
Figure 14B:
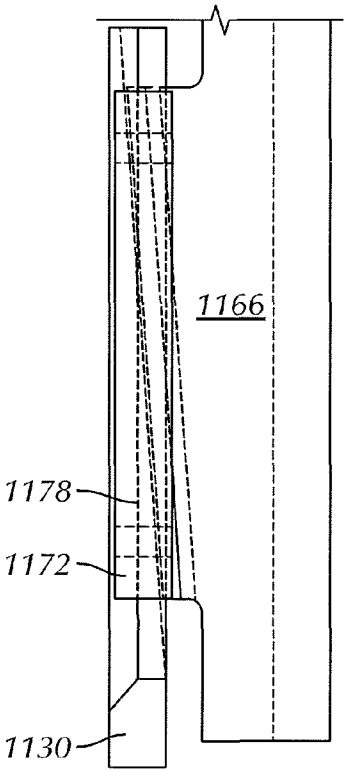

FIGS. 14A-14C show the clamping element 1166 engaged with the wedge 1130. Specifically, FIG. 14A shows a side view of the wedge 1130 engaged with the wedging track 1162 and the clamping element 1166 engaged with the wedge 1130. FIG. 14B shows a top view of the extension portion 1172 of the clamping element 1166 engaged within the longitudinal groove 1178 of the wedge 1130. FIG. 14C shows an end view of the extension portion 1172 of the clamping element 1166 engaged within the longitudinal groove 1178 of the wedge 1130.

Referring to FIGS. 11-14 together, screen 1108 may be installed in a vibratory separator 1100 and disposed on a screen support 1114 coupled to first and second walls 1106*a, b*. The first side 1120 of the screen 1108 may be engaged between the screen retainer 1116 and the screen support 1114. As discussed above with respect to various embodiments, the first side 1120 of the screen 1108 may include a beveled edge on an upper surface, a lower surface, or both. The second side 1122 of the screen 1108 may similarly include a beveled edge on an upper surface, a lower surface, or both. The second side 1122 of the screen 1108 is configured to engage the clamping element 1166. The clamping element may include a first side 1168 that engages the screen 1108 and a second side 1170 that extends through an opening 1164 or slot formed in the second wall 1106*b* longitudinally aligned with a length of the screen 1108.

In some embodiments, the clamping element 1166 may be secured to the second wall 1106*b* by any fastening means known in the art to keep the clamping element within the vibratory separator during installation of the screen 1108. For example, in some embodiments, the clamping element 1166 may be movably secured within the opening 1164 such that the screen 11008 may be slid onto the screen supports 1114 and engage the screen retainer 1116 and the clamping element 1166.

Once the screen 1108 is installed, the wedge 1130 may be engaged with the wedging track 1162 on an outside surface of the second wall 1106*b*. In other words, the wedge 1130 is disposed on a side of the second wall 1106*b* opposite the screen 1108. As the wedge 1130 is slid into the wedging track 1162, the second side 1170 of the clamping element 1166 slides into the longitudinal groove 1178 fanned on a first side 1174 of the wedge 1130. Because the depth d and width w of the longitudinal groove 1178 taper, the clamping element 1166 is wedged between the clamp 1130 and the screen 1108. This wedging action creates a lateral force acting on the screen 1108 in a direction toward the first wall 1106*a*. Thus, the as the wedge 1130 is installed and the engaged with the clamping element 1166, the screen 1108 is similarly engaged with the clamping element 1166 and secured within the vibratory separator 1100.

Embodiments disclosed herein also relate to a method of securing a screen in a vibratory separator. The method may include disposing a screen on a screen support in a vibratory separator, engaging a first side of the screen with a screen retainer coupled to the vibratory separator, and applying at least one of a downward vertical force and a lateral force to a second side of the screen with a clamping apparatus. In some embodiments, the engaging the first side of the screen with the screen retainer may include engaging an upper beveled edge of the first side of the screen with a corresponding angled surface of the screen retainer.

In one embodiment, the applying at least one of a downward vertical force and a lateral force to the second side of the screen with the clamping apparatus includes installing a wedge in the vibratory separator, contacting a first surface of the wedge with a wedge retainer coupled to a wall of the vibratory separator, the wedge retainer having a lower angled surface, and contacting a second surface of the wedge with an upper bevel of the second side of the screen. In one embodiment, the first surface of the wedge is perpendicular to a first side and second side of the wedge and the second surface of the wedge is perpendicular to the first side and the second side of the wedge.

In other embodiments, the applying at least one of a downward vertical force and a lateral force to the second side of the screen with the clamping apparatus includes installing a wedge in the vibratory separator, contacting a first surface of the wedge with a wedge retainer coupled to a wall of the vibratory separator, the wedge retainer having a lower surface parallel to a surface of the screen support, and contacting a second surface of the wedge with an upper bevel of the second side of the screen. In one embodiment, the first surface of the wedge is perpendicular to a first side and second side of the wedge and the second surface of the wedge is angled between the first side and the second side of the wedge.

In yet other embodiments, the applying at least one of a downward vertical force and a lateral force to the second side of the screen with the clamping apparatus includes installing a coupling element in an opening fanned in a wall of the vibratory separator, engaging a beveled surface of a first side of the coupling element with a corresponding beveled surface of the second side of the screen, engaging a wedge in a wedging track coupled to an outer surface of the wall of the vibratory separator, and engaging a second side of the coupling element with a groove formed on a side surface of the wedge.

In still other embodiments, the applying at least one of a downward vertical force and a lateral force to the second side of the screen with the clamping apparatus may include actuating a actuator coupled to the vibratory separator, and engaging the actuator with an upper surface of the screen proximate the second side of the screen.

Embodiments disclosed herein may provide a clamping apparatus for securing a screen in a vibratory separator. In particular, a clamping apparatus in accordance with embodiments disclosed herein may include a clamping apparatus on a single side of a screen. As it may be difficult to access clamping or wedging apparatus from the center of a vibratory separator, embodiments disclosed herein provide a vibratory separator having one or more screens disposed therein, wherein each screen may include one or more clamping apparatus on a single side of the screen. In other words, a clamping apparatus, e.g., a wedge and wedge retainer or actuator, may be configured to engage only one side of each screen. The other side of the screen may be secured by a screen retainer or a track that does not require additional actuation or installation of additional components, such as a wedge. Thus, to remove or install a screen, the one or more clamping apparatus need only be removed from a single side of a screen. A vibratory separator with screens and clamping apparatus disposed on a single side of the screens may reduce the cost of components required for securing the screens in place and may decrease installation and removal time.

In one embodiment, an apparatus in accordance with embodiments disclosed herein includes a vibratory separator having a basket, a screen support coupled to an inner surface of the basket, a screen having a first side with an upper sloped edge and a second side with an upper sloped edge opposite the first side, the screen configured to engage the screen support, a screen retainer coupled to the basket and configured to engage the upper sloped edge of the first side of the screen, a wedge retainer coupled to a sidewall of the basket opposite the screen retainer, and a wedge having a first surface configured to engage the wedge retainer and a second surface configured to engage the upper sloped edge of the second side of the screen.

Although only a few example embodiments have been described in detail above, those skilled in the art will readily appreciate that many modifications are possible in the example embodiments without materially departing from the single side screen clamping apparatus and methods disclosed herein. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed:

1. An apparatus comprising:

a vibratory separator;

a screen support coupled to an inner surface of the vibratory separator;

a screen having a first side with at least one sloped edge and a second side opposite the first side, the second side having at least one sloped edge, the screen configured to engage the screen support;

a screen retainer coupled to the vibratory separator and configured to engage the at least one sloped edge of the first side of the screen;

a wedge retainer coupled to a sidewall of the vibratory separator opposite the screen retainer; and a wedge having a first surface configured to engage the wedge retainer and a second surface configured to engage the at least one sloped edge of the second side of the screen.

2. The apparatus of claim 1, wherein the wedge retainer comprises a lower angled surface configured to engage the first surface of the wedge.

3. The apparatus of claim 2, wherein the first surface of the wedge is parallel to the second surface of the wedge.

4. The apparatus of claim 3, wherein an angle of the lower angled surface of the wedge retainer is approximately equal to an angle of the at least one sloped edge of the second side of the screen.

5. The apparatus of claim 1, wherein the wedge retainer comprises a lower surface parallel to the screen support.

6. The apparatus of claim 5, wherein the first surface of the wedge is parallel to the lower surface of the wedge retainer and wherein an angle of the lower surface of the second surface of the wedge is approximately equal to an angle of the at least one sloped edge of the second side of the screen.

7. The apparatus of claim 1, wherein the screen support is angled downward with respect to the sidewall of the vibratory separator.

8. The apparatus of claim 7, wherein the at least one sloped edge of the first side of the screen includes a lower bevel and the at least one sloped edge of the second side of the screen includes a lower bevel, and wherein the lower bevel of the first side and the lower bevel of the second side are configured to engage the downwardly angled screen support.

9. An apparatus comprising:

a vibratory separator;

a screen support coupled to the vibratory separator and configured to receive a screen;

a screen retainer coupled to the vibratory separator above the screen support and configured to engage an upper surface of the screen;

a wedging track coupled to an outside surface of a side wall of the vibratory separator; and a wedge configured to engage the wedging track and configured to engage the screen through an opening in the side wall.

10. The apparatus of claim 9, further comprising a clamping element having a first side and a second side, the first side of clamping element configured to engage the screen and the second side of the clamping element configured to extend through the opening formed in the side wall, wherein the wedge is configured to engage the second side of the clamping element.

11. The apparatus of claim 10, wherein the first side of the clamping element is beveled.

12. The apparatus of claim 9, wherein a first side surface of the wedge includes a longitudinal groove configured to receive the second side of the clamping element.

13. The apparatus of claim 10, wherein a depth of the longitudinal groove is tapered along a length of the wedge.

14. The apparatus of claim 12, wherein a width of the longitudinal groove is tapered along a length of the wedge.

15. A method comprising:

disposing a screen on a screen support in a vibratory separator, the screen having a screening surface extending between a first side and a second side;

engaging the first side of the screen with a screen retainer coupled to the vibratory separator; and applying at least one of a downward vertical force and a lateral force to the second side of the screen with a clamping apparatus.

16. The method of claim 15, wherein the applying comprises installing a wedge in the vibratory separator, the installing comprising:

contacting a first surface of the wedge with a wedge retainer coupled to a wall of the vibratory separator, the wedge retainer comprising a lower angled surface, wherein the first surface of the wedge is perpendicular to a first side and second side of the wedge; and contacting a second surface of the wedge with an upper sloped edge of the second side of the screen, wherein the second surface of the wedge is perpendicular to the first side and the second side of the wedge.

17. The method of claim 15, wherein the applying comprises installing a wedge in the vibratory separator, the installing comprising:

contacting a first surface of the wedge with a wedge retainer coupled to a wall of the vibratory separator, the wedge retainer comprising a lower surface parallel to a surface of the screen support, wherein the first surface of the wedge is perpendicular to a first side and a second side of the wedge; and contacting a second surface of the wedge with an upper sloped edge of the second side of the screen, wherein the second surface of the wedge is angled between the first and second side of the wedge.

18. The method of claim 15, wherein the applying comprises:

installing a coupling element in an opening formed in a wall of the vibratory separator;

engaging a beveled surface of a first side of the coupling element with a corresponding beveled surface of the second side of the screen;

engaging a wedge in a wedging track coupled to an outer surface of the wall of the vibratory separator; and engaging a second side of the coupling element with a groove formed on a side surface of the wedge.

19. The method of claim 15, wherein the applying comprises actuating an actuator coupled to the vibratory separator, and engaging the actuator with an upper surface of the screen proximate the second side.

20. The method of claim 15, wherein the engaging a first side of the screen with a screen retainer comprises engaging an upper sloped edge of the first side of the screen with a corresponding angled surface of the screen retainer.

* * * * *

UNITED STATES PATENT AND TRADEMARK OFFICE

CERTIFICATE OF CORRECTION

PATENT NO. : 8,827,080 B2
APPLICATION NO. : 13/672429
DATED : September 9, 2014
INVENTOR(S) : Benjamin Lanning Holton It is certified that error appears in the above-identified patent and that said Letters Patent is hereby corrected as shown below:

On the Title Page:

At item 71, the Applicant is listed as "Benjamin Lanning Holton" when it should be, "M-I, L.L.C.".

Signed and Sealed this
Twenty-third Day of December, 2014

Michelle K. Lee

Michelle K. Lee
*Deputy Director of the United States Patent and Trademark Office*